US010056090B2

(12) United States Patent
Hu et al.

(10) Patent No.: US 10,056,090 B2
(45) Date of Patent: Aug. 21, 2018

(54) SPEECH/AUDIO SIGNAL PROCESSING METHOD AND CODING APPARATUS

(71) Applicant: Huawei Technologies Co., Ltd., Shenzhen, Guangdong (CN)

(72) Inventors: Chen Hu, Shenzhen (CN); Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 239 days.

(21) Appl. No.: 14/562,494

(22) Filed: Dec. 5, 2014

(65) Prior Publication Data

US 2015/0095038 A1 Apr. 2, 2015

Related U.S. Application Data

(63) Continuation of application No. PCT/CN2013/076862, filed on Jun. 6, 2013.

(30) Foreign Application Priority Data

Jun. 29, 2012 (CN) ..... 2012 1 0223014

(51) Int. Cl.
*G10L 19/26* (2013.01)
*G10L 19/18* (2013.01)
(Continued)

(52) U.S. Cl.
CPC ..... *G10L 19/265* (2013.01); *G10L 19/18* (2013.01); *G10L 19/012* (2013.01); *G10L 19/22* (2013.01)

(58) Field of Classification Search
CPC ..... G10L 19/24; G10L 19/18; G10L 19/26; G10L 19/22; G10L 19/167
See application file for complete search history.

(56) References Cited

U.S. PATENT DOCUMENTS 4,441,202 A * 4/1984 Tong ..... A61F 11/04 381/312
5,574,724 A 11/1996 Bales et al.
(Continued)

FOREIGN PATENT DOCUMENTS

CN 101641734 A 2/2010
CN 101662288 A 3/2010
(Continued)

OTHER PUBLICATIONS

"TD-WP3-TDWP3_G722SWB-Att.1-g_722_SWB_text", ITUT Draft; Study Period 2009-2012, International Telecommunication Union, Jul. 28, 2010, p. 1-89.
(Continued)

*Primary Examiner* — Matthew Baker

(57) ABSTRACT

The present disclosure provides a speech/audio signal processing method based on wideband switching and a coding apparatus. The method includes: if a first wideband speech/audio signal is a harmonic signal, adjusting a determining condition for determining that a second wideband speech/audio signal is a harmonic signal, to obtain a first determining condition, where the first wideband speech/audio signal is a signal before wideband switching, and the second wideband speech/audio signal is a signal after the wideband switching; and determining, according to the first determining condition, whether the second wideband speech/audio signal is a harmonic signal. In the case of wideband switching, signal types of speech/audio signals remain as consistent as possible before and after the switching, so that continuity of the speech/audio signal decoded by a decoder device is ensured as much as possible, further improving speech communication service quality.

20 Claims, 6 Drawing Sheets

(51) Int. Cl.
*G10L 19/22* (2013.01)
*G10L 19/012* (2013.01)

(56) References Cited

U.S. PATENT DOCUMENTS 7,801,733 B2 9/2010 Lee et al.
8,103,515 B2 * 1/2012 Chen ..... G10L 19/025 704/500
2001/0044712 A1 11/2001 Vainio et al.
2004/0002854 A1 1/2004 Ha
2005/0065786 A1 3/2005 Stachurski et al.
2005/0246164 A1 11/2005 Ojala et al.
2006/0149538 A1 * 7/2006 Lee ..... G10L 19/0204 704/219
2007/0067163 A1 * 3/2007 Kabal ..... G10L 21/038 704/207
2008/0059166 A1 * 3/2008 Ehara ..... G10L 19/07 704/230
2009/0306992 A1 12/2009 Ragot et al.
2010/0063803 A1 * 3/2010 Gao ..... G10L 21/0364 704/205
2010/0228557 A1 * 9/2010 Chen ..... G10L 21/038 704/500
2012/0029926 A1 * 2/2012 Krishnan ..... G10L 19/038 704/500
2012/0146831 A1 * 6/2012 Eksler ..... G10L 19/038 341/200
2014/0303967 A1 * 10/2014 Jeong ..... G10L 19/032 704/205
2015/0095038 A1 * 4/2015 Hu ..... G10L 19/18 704/500
2015/0228288 A1 * 8/2015 Subasingha ..... G10L 19/0204 704/500
2015/0317994 A1 * 11/2015 Ramadas ..... G10L 19/24 704/226
2016/0111103 A1 * 4/2016 Nagisetty ..... G10L 19/167 704/501

FOREIGN PATENT DOCUMENTS

CN 101903945 A 12/2010
CN 101964189 A 2/2011
EP 2 485 029 A1 8/2012
JP 2003-533717 11/2003
JP 2007-532963 11/2007
JP 2010-176090 8/2010
KR 10-2006-0078362 7/2006

OTHER PUBLICATIONS

"7kHz audio-coding within 64 kbit/s, Amendment 1: New Annex B with superwideband embedded extension", Recommendation ITU-T G.722 (1988)—Amendment 1, Nov. 2010, 93 pages.

* cited by examiner

SPEECH/AUDIO SIGNAL PROCESSING METHOD AND CODING APPARATUS

CROSS-REFERENCE TO RELATED APPLICATIONS

This application is a continuation of International Application No. PCT/CN2013/076862, filed on Jun. 6, 2013, which claims priority to Chinese Patent Application No. 201210223014.0, filed on Jun. 29, 2012, both of which are hereby incorporated by reference in their entireties.

TECHNICAL FIELD

The present disclosure relates to communications technologies, and in particular, to a speech/audio signal processing method and a coding apparatus.

BACKGROUND

In the digital communications field, there is a vast application demand for speech, image, audio, and video transmission, such as mobile phone communication, audio and video conference, broadcast television, and multimedia entertainment. A speech/audio signal is digitized and transferred from one terminal to another terminal by using a communications network. The terminal herein may be a mobile phone, a digital telephone terminal, or a speech and audio terminal of any other type. The digital phone terminal may be, for example, a VOIP telephone, an ISDN telephone, a computer, or a cable communications telephone. To reduce resources occupied in a storage or transmission process of a speech/audio signal, the speech/audio signal is compressed at a transmit end and is transmitted to a receive end, and the receive end restores the speech/audio signal by decompressing processing and plays the speech/audio signal.

In an actual speech communication process, bandwidth of a speech/audio signal often changes. A cause that leads to the bandwidth change of the speech/audio signal may be a change of a network status, may be a bandwidth change of the speech/audio signal itself, or may be another factor that can cause switching of the speech/audio signal between a high-frequency signal and a low-frequency signal. The process in which a speech/audio signal switches between high and low frequencies is referred to as wideband switching.

Specifically, the network status often changes and network bandwidth becomes narrow as the network status deteriorates. Accordingly, with the change of the network bandwidth, the speech/audio signal also needs to switch between the high-frequency signal and the low-frequency signal. When the network bandwidth becomes narrow, the speech/audio signal needs to change from the high-frequency signal to the low-frequency signal; when a network situation recovers, the speech/audio signal needs to recover from the low-frequency signal to the high-frequency signal. A bandwidth size of the high-frequency signal and the low-frequency signal is a relative concept. For example, bandwidth of the high-frequency signal is 0-16 kHZ and bandwidth of the low-frequency signal is 0-8 kHz; or bandwidth of the high-frequency signal is 0-8 kHz and bandwidth of the low-frequency signal is 0-4 kHz, where the high-frequency signal is also an ultra-wideband signal and the low-frequency signal is also a wideband signal.

However, after wideband switching is performed by using the prior art at an encoder, a problem of discontinuous speech/audio signals often occurs at a decoder, which thereby degrades speech communication service quality.

SUMMARY

Embodiments of the present disclosure provide a speech/audio signal processing method based on wideband switching and a coding apparatus.

An embodiment of the present disclosure provides a speech/audio signal processing method based on wideband switching, including:

if a first wideband speech/audio signal is a harmonic signal, adjusting a determining condition for determining that a second wideband speech/audio signal is a harmonic signal, to obtain a first determining condition, so as to raise a possibility of determining that the second wideband speech/audio signal is a harmonic signal, where the first wideband speech/audio signal is a signal before wideband switching, and the second wideband speech/audio signal is a signal after the wideband switching; and determining, according to the first determining condition, whether the second wideband speech/audio signal is a harmonic signal.

An embodiment of the present disclosure further provides a coding apparatus, including:

a determining condition adjusting module, configured to: if a first wideband speech/audio signal is a harmonic signal, adjust a determining condition for determining that a second wideband speech/audio signal is a harmonic signal, to obtain a first determining condition, so as to raise a possibility of determining that the second wideband speech/audio signal is a harmonic signal, where the first wideband speech/audio signal is a signal before wideband switching, and the second wideband speech/audio signal is a signal after the wideband switching; and a signal type determining module, configured to determine, according to the first determining condition, whether the second wideband speech/audio signal is a harmonic signal.

In the embodiments of the present disclosure, a coding apparatus can determine whether a first wideband speech/audio signal before wideband switching is a harmonic signal, and when it is determined that the first wideband speech/audio signal is a harmonic signal, use a manner of adjusting a harmonic signal determining condition for a second wideband speech/audio signal after the wideband switching to loosen a condition of determining whether the second wideband speech/audio signal after the wideband switching is a harmonic signal, so as to raise, as much as possible, a possibility of determining that the second wideband speech/audio signal is a harmonic signal. Therefore, in the embodiments of the present disclosure, in the case of the wideband switching, signal types of speech/audio signals remain as consistent as possible before and after the switching, so that continuity of the speech/audio signal decoded by a decoder device is ensured as much as possible, further improving speech communication service quality.

BRIEF DESCRIPTION OF THE DRAWINGS

To describe the technical solutions in the embodiments of the present disclosure more clearly, the following briefly introduces the accompanying drawings required for describing the embodiments or the prior art. Apparently, the accompanying drawings in the following description show some embodiments of the present disclosure, and a person of ordinary skill in the art may still derive other drawings from these accompanying drawings without creative efforts.

DETAILED DESCRIPTION

To make the objectives, technical solutions, and advantages of the embodiments of the present disclosure clearer, the following clearly describes the technical solutions in the embodiments of the present disclosure with reference to the accompanying drawings in the embodiments of the present disclosure. Apparently, the described embodiments are a part rather than all of the embodiments of the present disclosure. All other embodiments obtained by a person of ordinary skill in the art based on the embodiments of the present disclosure without creative efforts shall fall within the protection scope of the present disclosure.

The speech/audio signal processing method according to the present disclosure may be applied to an audio coder. In the field of digital signal processing, audio codecs are widely applied to various electronic devices, for example, a mobile phone, a wireless apparatus, a personal data assistant (PDA), a handheld or portable computer, a GPS receiver/navigator, a camera, an audio/video player, a camcorder, a video recorder, and a monitoring device. Usually, this type of electronic device includes an audio coder or an audio decoder, where the audio coder or decoder may be directly implemented by a digital circuit or a chip, for example, a digital signal processor (DSP), or be implemented by software code driving a processor to execute a process in the software code.

Figure 1:
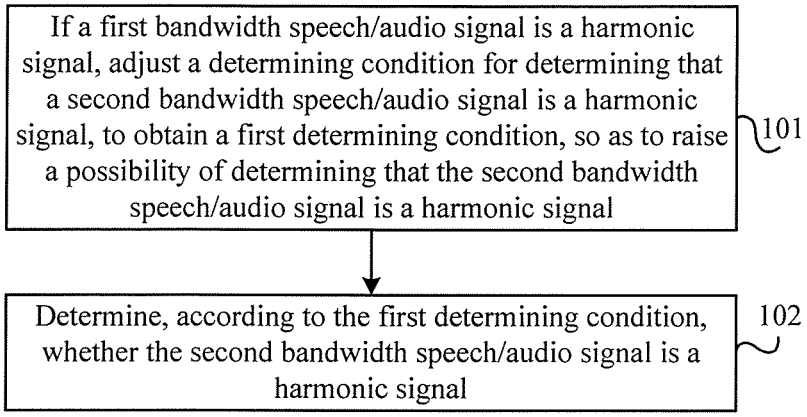
FIG. 1 is a flowchart of a first embodiment of a speech/audio signal processing method according to the present disclosure.

FIG. 1 is a flowchart of a first embodiment of a speech/audio signal processing method according to the present disclosure. As shown in FIG. 1, the method according to this embodiment may include:

Step 101. If a first wideband speech/audio signal is a harmonic signal, adjust a determining condition for determining that a second wideband speech/audio signal is a harmonic signal, to obtain a first determining condition, so as to raise a possibility of determining that the second wideband speech/audio signal is a harmonic signal.

The first wideband speech/audio signal is a speech/audio signal before wideband switching, and the second wideband speech/audio signal is a speech/audio signal after the wideband switching.

Step 102. Determine, according to the first determining condition, whether the second wideband speech/audio signal is a harmonic signal.

Specifically, a high-frequency signal may be an ultra-wideband signal, and a low-frequency signal may be a wideband signal. A person skilled in the art may self-define, according to a requirement, a signal above a bandwidth range as an ultra-wideband signal and a signal in or below the certain bandwidth range as a wideband signal. For example, it may be set that a signal above a bandwidth range of 0-8 kHz is an ultra-wideband signal, and a signal in or below the bandwidth range of 0-8 kHz is a wideband signal. During coding at an encoder, an ultra-wideband signal may be classified into a harmonic signal, a common signal, a transient signal, and a noise signal, and a wideband signal may be classified into a harmonic signal and a common signal.

The first wideband speech/audio signal in this embodiment may be an ultra-wideband signal, and the second wideband speech/audio signal after the switching may be a wideband signal; or the first wideband speech/audio signal may be a wideband signal, and the second wideband speech/audio signal after the switching may be an ultra-wideband signal. For the ultra-wideband signal, its signal type may be one of the harmonic signal, the common signal, the transient signal, and the noise signal; for the wideband signal, its signal type may be one of the harmonic signal and the common signal. For the ultra-wideband signal, a coding apparatus may use a harmonic signal determining condition corresponding to an ultra-wideband signal to determine a signal type of the ultra-wideband signal; for the wideband signal, the coding apparatus may use a harmonic signal determining condition corresponding to a wideband signal to determine a signal type of the wideband signal. In the prior art, both the harmonic signal determining condition corresponding to an ultra-wideband signal and the harmonic signal determining condition corresponding to a wideband signal need to use information about a signal of a previous frame as reference information during determining of a harmonic signal.

The inventor finds in a practice process of the prior art that: in the case of wideband switching at an encoder, if a speech/audio signal before the wideband switching is a harmonic signal of an ultra-wideband signal or a harmonic signal of a wideband signal, intermittent speech often occurs at a decoder, which thereby affects normal communication of users and degrades speech communication service quality.

After a careful study, the inventor finds that a main cause of the foregoing problem lies in that: both the harmonic signal determining condition corresponding to an ultra-wideband signal and the harmonic signal determining condition corresponding to a wideband signal need to use information about a signal of a previous frame as reference information during the determining of a harmonic signal; however, when wideband switching occurs, energy and frequency bands of signals before and after the wideband switching are greatly different because signal bandwidth changes. Based on this change, if the coding apparatus still uses the signal before the wideband switching as reference information for determining a type of the signal after the wideband switching, the coding apparatus may perform switching of the signal type during the wideband switching.

For example, a speech/audio signal before the wideband switching is a harmonic signal, but it may be determined that the speech/audio signal after the wideband switching is a transient signal. The encoder may use a coding method for a harmonic signal to code a harmonic signal before the wideband switching and use a coding method for a non-harmonic signal to code a non-harmonic signal after the wideband switching. Later, the encoder may send the coded signal to the decoder, and the decoder may use a corresponding decoding method to decode the coded signal after receiving the coded signal, so as to restore the harmonic signal and the non-harmonic signal. Because there is a significant difference between the harmonic signal and the non-harmonic signal in terms of signal features, output of the two signals makes the speech/audio signal, heard by a user at the decoder, intermittent. With respect to switching between three signal types of the non-harmonic signal, that is, the noise signal, the transient signal, and the common signal, for a decoder device, the decoded speech/audio signal is not significantly affected.

Therefore, in this embodiment, the coding apparatus can determine whether the first wideband speech/audio signal before the wideband switching is a harmonic signal. If the first wideband speech/audio signal before the wideband switching is a harmonic signal, the coding apparatus may use a manner of adjusting the harmonic signal determining condition to raise the possibility of determining that the second wideband speech/audio signal after the wideband switching is a harmonic signal. Therefore, in the case of the wideband switching, a signal type of the speech/audio signal is not changed as much as possible during determining of the speech/audio signal after the wideband switching, so that signal types of speech/audio signals received at the decoder device are consistent before and after the wideband switching, that is, a same decoding manner can be used for decoding, so as to ensure continuity of the speech/audio signal as much as possible. The signal type of the second wideband speech/audio signal is changed only when the second wideband speech/audio signal after the switching does not meet a loosened harmonic signal determining condition either, that is, only when there are rather few harmonic components in the second wideband speech/audio signal. In this embodiment, if the first wideband speech/audio signal is an ultra-wideband signal, the second wideband speech/audio signal is a wideband signal; if the first wideband speech/audio signal is a wideband signal, the second wideband speech/audio signal is an ultra-wideband signal.

In an example in which a first wideband speech/audio signal is an ultra-wideband signal and a second wideband speech/audio signal is a wideband signal, the coding apparatus may use the harmonic signal determining condition corresponding to an ultra-wideband signal to determine whether an ultra-wideband signal before the wideband switching is a harmonic signal or a non-harmonic signal, where the non-harmonic signal is one of the transient signal, the noise signal, and the common signal. If a result of the determining is that the ultra-wideband signal before the wideband switching is a harmonic signal, the coding apparatus may loosen the harmonic signal determining condition corresponding to a wideband signal to obtain the first determining condition, and determine, according to the first determining condition, whether a wideband signal after the wideband switching is a harmonic signal. Because the harmonic signal determining condition corresponding to a wideband signal is loosened, a possibility of determining that the wideband signal after the switching is a harmonic signal is increased, so that signal types before and after the wideband switching are not changed as much as possible, and further, continuity of the speech/audio signal decoded by the decoder device is ensured as much as possible.

It should be noted that a person skilled in the art may design the harmonic signal determining condition corresponding to an ultra-wideband signal and the harmonic signal determining condition corresponding to a wideband signal according to a speech/audio signal processing method or use a harmonic signal determining condition stipulated in a standard, which is not limited in this embodiment.

In this embodiment, a coding apparatus can determine whether a first wideband speech/audio signal before wideband switching is a harmonic signal, and when it is determined that the first wideband speech/audio signal is a harmonic signal, use a manner of adjusting a harmonic signal determining condition for a second wideband speech/audio signal after the wideband switching, to loosen a condition of determining whether the second wideband speech/audio signal after the wideband switching is a harmonic signal, so as to raise, as much as possible, a possibility of determining that the second wideband speech/audio signal is a harmonic signal. Therefore, in this embodiment, in the case of the wideband switching, signal types of speech/audio signals remain consistent as possible before and after the switching, so that continuity of a speech/audio signal decoded by a decoder device is ensured as much as possible, and further, speech communication service quality is improved.

Based on the method embodiment shown in FIG. 1, if the coding apparatus determines that the first wideband speech/audio signal is not a harmonic signal, before the coding apparatus performs step 102 in the method embodiment shown in FIG. 1, the method may further include:

adjusting the harmonic signal determining condition to obtain a second determining condition, so as to decrease the possibility of determining that the second wideband speech/audio signal is a harmonic signal, and further determining, according to the second determining condition, whether the second wideband speech/audio signal is a harmonic signal.

Specifically, if the coding apparatus determines that the first wideband speech/audio signal before the wideband switching is not a harmonic signal, the coding apparatus may use a manner of adjusting the harmonic signal determining condition to increase a determining threshold for determining that the second wideband speech/audio signal is a harmonic signal, so as to decrease the possibility of determining that the second wideband speech/audio signal is a harmonic signal. That is, if the first wideband speech/audio signal before the wideband switching is a non-harmonic signal, for example, a noise signal, a transient signal, or a common signal, it may be determined to a great extent, by increasing the harmonic signal determining threshold, that the second wideband speech/audio signal after the wideband switching is a noise signal, a transient signal, or a common signal, but not a harmonic signal. The encoder does not change a signal type of the speech/audio signal during the wideband switching as much as possible, and the continuity of the speech/audio signal decoded by the decoder can be ensured as much as possible.

As mentioned above, if the first wideband speech/audio signal is an ultra-wideband signal, the second wideband speech/audio signal is a wideband signal; if the first wideband speech/audio signal is a wideband signal, the second wideband speech/audio signal is an ultra-wideband signal. The following describes in detail the technical solutions of the present disclosure by using different embodiments for different wideband switching situations.

First, the harmonic signal determining condition and a non-harmonic signal determining condition that are corresponding to an ultra-wideband signal and the harmonic signal determining condition and a non-harmonic signal determining condition that are corresponding to a wideband signal that are used in the following embodiments are described in detail. It should be noted that in the following embodiments, a signal type determining condition stipulated in a standard is used as an example to determine whether a speech/audio signal is a harmonic signal or a non-harmonic signal. A person skilled in the art may understand that these determining conditions can be changed according to the speech/audio signal processing method.

For an ultra-wideband signal, the following manner may be used to determine a signal type of the ultra-wideband signal:

(1) Divide a current speech/audio signal into multiple signal segments to obtain multiple segments of a time domain signal and determine a time envelope parameter value for each segment of the time domain signal. Optionally, before the time envelope parameter value for each segment of the time domain signal is determined, each segment of the time domain signal may also be multiplied by a proportion factor according to an importance degree of each segment of the time domain signal in the entire speech/audio signal to obtain a time domain signal used for determining the time envelope parameter value.

(2) Determine whether one time envelope parameter value of multiple time envelop parameter values of the time domain signal is greater than a given envelope threshold T1, where the envelope threshold T1 is obtained by performing a weighted sum of several previous envelope values of the speech/audio signal and then multiplying a result by a preset value.

(3) If at least one time envelope threshold value is greater than T1, determine that the current speech/audio signal is a transient signal.

Step 1 to step 3 are a transient signal determining condition.

(4) If no time envelope threshold value is greater than T1, divide a frequency domain signal of the current speech/audio signal into multiple frequency bands, calculate one frequency domain amplitude peak value of each frequency band, and then calculate a harmonic characteristic value of each frequency band according to the frequency domain amplitude peak values, an average value of the frequency domain amplitude peak values of the multiple frequency bands, and a frequency band width.

(5) Determine whether the harmonic characteristic value of each frequency band is greater than a given threshold and whether the frequency domain amplitude peak value of each frequency band is greater than a given threshold T2. If both the harmonic characteristic value of each frequency band and the frequency domain amplitude peak value of each frequency band are greater than the given thresholds, determine that the frequency band is a harmonic frequency band and perform step 6; otherwise, further determine whether the harmonic characteristic value is less than a given threshold T3. If the harmonic characteristic value is less than the given threshold T3, determine the frequency band is a noise frequency band; otherwise, determine the frequency band is a common frequency band.

(6) Determine a value of the maximum peak value parameter, that is, a maximum value of the amplitude peak values of all the frequency bands, calculate a quantity of harmonic frequency bands and a quantity of noise frequency bands, and calculate a ratio of global energy of the current speech/audio signal to global energy of a previous speech/audio signal.

(7) Determine whether the value of the maximum peak value parameter is greater than a given threshold T4, whether the quantity of harmonic frequency bands is greater than a given threshold T5, and whether the global energy ratio falls within a given threshold range (T6, T7). If all determining results are yes, determine that the current speech/audio signal is a harmonic signal, and update a harmonic mode counter, for example, add 1 to a count value of the harmonic mode counter.

(8) If not all the three determining results are yes, update a harmonic mode counter, for example, subtract 1 from a count value of the harmonic mode counter, and determine whether the harmonic mode count value is greater than a given threshold T8 in this case. If the harmonic mode count value is greater than the given threshold T8, determine that the current speech/audio signal is a harmonic signal.

Step 4 to step 8 are a harmonic signal determining condition.

It should be noted that the harmonic mode counter is an optional function. When a value of a maximum peak value parameter of the current speech/audio signal is less than or equal to the given threshold T4, the quantity of harmonic frequency bands is less than or equal to the given threshold T5, and the global energy ratio does not fall within the given threshold range (T6, T7), the harmonic mode counter may be used as a reference for determining whether the current speech/audio signal is a harmonic signal. If a quantity of previously accumulated harmonic signals exceeds the given threshold T8, it indicates that the continuous speech/audio signal is more likely a harmonic signal, and in this case, even though the foregoing three conditions are not met, it may also be determined that the current speech/audio signal is a harmonic signal.

(9) If it is determined that the current speech/audio signal is not a harmonic signal, further determine whether the quantity of noise frequency bands and another noise-related parameter meet a condition. If the quantity of noise frequency bands and another noise-related parameter meet a condition, determine that the current speech/audio signal is a noise signal; otherwise, determine that the current speech/audio signal is a common signal.

For the wideband signal, only a harmonic signal and a common signal need to be distinguished. However, in a wideband switching process, the harmonic signal determining condition is similar to a principle for determining an ultra-wideband signal and is specifically as follows:

When determining whether the current speech/audio signal is a harmonic signal, the coding apparatus only needs to determine whether the quantity of harmonic frequency bands and the value of the maximum peak value parameter are greater than the given thresholds T4 and T5, respectively, and if the harmonic frequency band quantity and the value of the maximum peak value parameter are greater than the given thresholds T4 and T5 respectively, determine that the current speech/audio signal is a harmonic signal and increase the value of the harmonic mode counter, for example, add 1 to the count value of the harmonic mode counter, or if either of the harmonic frequency band quantity and the maximum peak value parameter value is less than or equal to the give threshold T4 or T5, decrease the value of the harmonic mode counter, for example, subtract 1 from the count value of the harmonic mode counter; and then determine whether the count value of the harmonic mode counter is greater than the given threshold T8, and if the count value of the harmonic mode counter is greater than the given threshold T8, determine that the current speech/audio signal is a harmonic signal, or if the count value of the harmonic mode counter is greater than the given threshold T8, determine that the current speech/audio signal is a common signal.

Based on the foregoing description of the determining of signal types of the wideband signal and the ultra-wideband signal, the following describes in detail the technical solution of the present disclosure.

Figure 2:
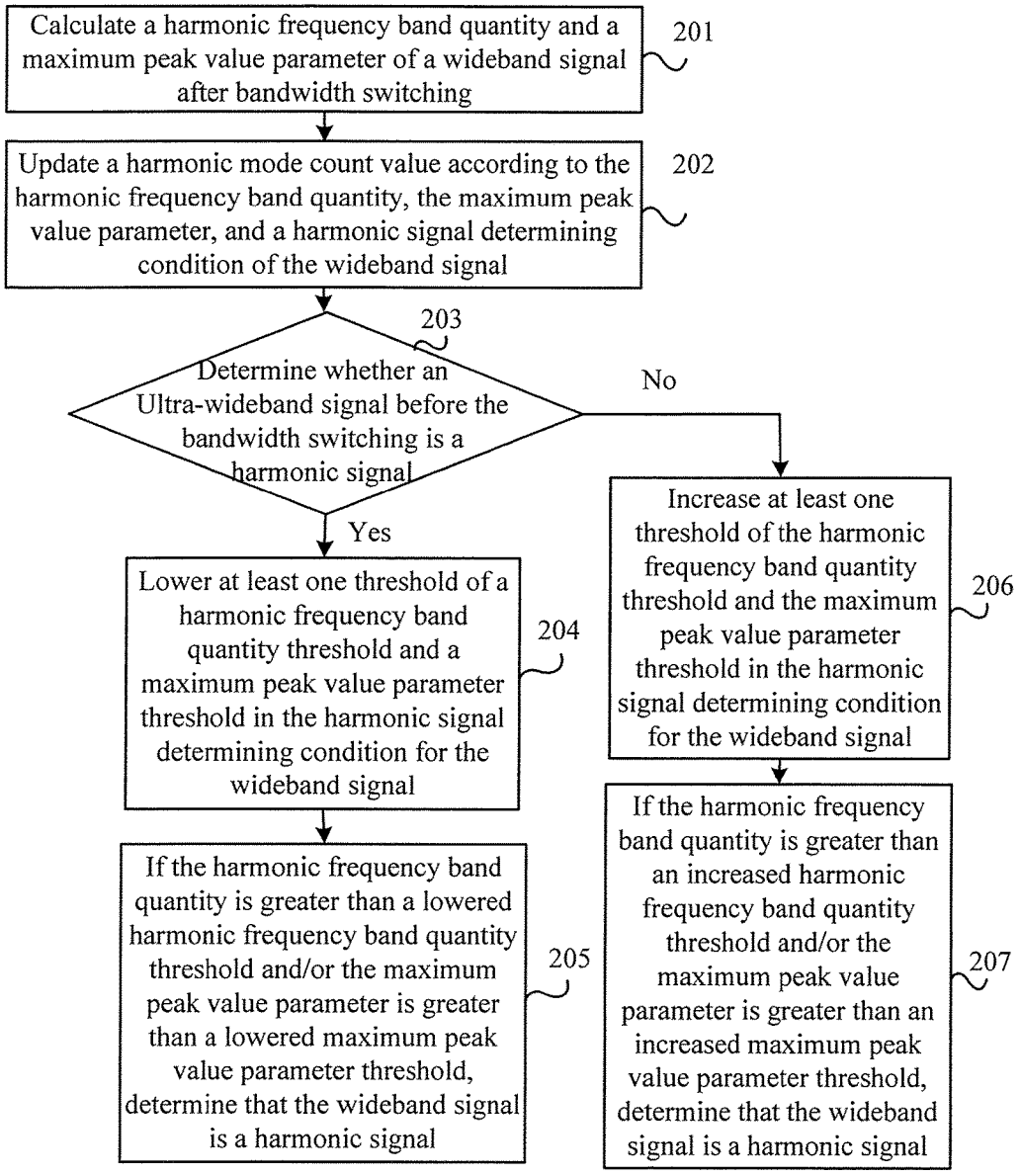
FIG. 2 is a flowchart of a second embodiment of a speech/audio signal processing method according to the present disclosure.

FIG. 2 is a flowchart of a second embodiment of a speech/audio signal processing method according to the present disclosure. In this embodiment, a first wideband speech/audio signal is an ultra-wideband signal, a second wideband speech/audio signal is a wideband signal, and wideband switching is switching from the ultra-wideband signal to the wideband signal. As shown in FIG. 2, the method in this embodiment may include:

Step 201. Calculate a quantity of harmonic frequency bands and a maximum peak value parameter of a wideband signal after the wideband switching.

This step may be implemented by using the foregoing step 6 and therefore no further details are provided herein.

Step 202. Update a harmonic mode count value according to the quantity of harmonic frequency bands, the maximum peak value parameter, and a harmonic signal determining condition for the wideband signal.

This step may be implemented by using, for example, the foregoing step 7. It should be noted that, for the wideband signal, a global energy ratio does not need to be calculated, but only determining of the quantity of harmonic frequency bands and the maximum peak value parameter in the harmonic signal determining condition for the wideband signal is used, so that a harmonic mode counter can be updated. If the quantity of harmonic frequency bands is greater than a given threshold T5 and the maximum peak value parameter is greater than a given threshold T4, it may be determined that the wideband signal after the wideband switching is a harmonic signal, and then 1 may be added to a value of the harmonic mode counter; if the harmonic frequency band quantity is less than or equal to the given threshold T5 and/or the maximum peak value parameter is less than or equal to the given threshold T4, it may be determined that the wideband signal after the wideband switching is a non-harmonic signal, and then 1 may be subtracted from the value of the harmonic mode counter. Therefore, it can be learned that determining whether the wideband signal after the wideband switching is a harmonic signal or a non-harmonic signal is based on an objective signal type of the wideband signal, and the harmonic mode counter updated thereof is objective information of previous speech/audio signals that can be used as a reference during determining of a subsequent speech/audio signal.

Step 203. Determine whether an ultra-wideband signal before the wideband switching is a harmonic signal. If the ultra-wideband signal before the wideband switching is a harmonic signal, perform step 204; if the ultra-wideband signal before the wideband switching is not a harmonic signal, perform step 206.

It should be noted that step 203 needs to be performed before step 204 but is not necessarily be performed after step 201 or step 202. In an actual processing process, step 203 can be performed before the wideband switching.

Step 204. Lower at least one threshold of a harmonic frequency band quantity threshold and a maximum peak value parameter threshold in the harmonic signal determining condition for the wideband signal.

Because the ultra-wideband signal before the wideband switching is a harmonic signal, a condition of determining that the wideband signal after the wideband switching is a harmonic signal needs to be loosened in step 204. In this embodiment, at least one threshold of the harmonic frequency band quantity threshold T5 and the maximum peak value parameter threshold T4 in the harmonic signal determining condition for the wideband signal may be decreased. It may be understood that, for an adjusting manner of decreasing both T4 and T5, a loosening degree of the harmonic signal determining condition is relatively larger when compared with an adjusting manner of decreasing T4 only or decreasing T5 only. In this embodiment, a decreased harmonic frequency band quantity threshold may be marked as T51, where T51<T5; and a decreased maximum peak value parameter threshold is marked as T41, where T41<T4. For example, T51 may be half of T5, and T41 is half of T4.

A person skilled in the art may understand that specific values of T51 and T41 can be set according to a harmonic signal determining requirement. For example, if it needs to be determined as much as possible that a wideband signal with a certain harmonic feature is a harmonic signal, T51 and T41 may be adjusted to smaller values, thereby loosening the harmonic signal determining condition to a greater extent.

Step 205. If the quantity of harmonic frequency bands is greater than a decreased harmonic frequency band quantity threshold and/or the maximum peak value parameter is greater than a decreased maximum peak value parameter threshold, determine that the wideband signal is a harmonic signal.

After the harmonic signal determining condition is loosened, if either condition of the two conditions that the harmonic frequency band quantity is greater than T51 and the maximum peak value parameter is greater than T41 is met, it can be determined that the wideband signal after the wideband switching is a harmonic signal. It should be noted that when a harmonic signal is performed in the prior art, both the two conditions that the harmonic frequency band quantity is greater than T5 and the maximum peak value parameter is greater than T4 need to be met; however, in this embodiment, not only the determining thresholds of T5 and T4 are decreased, but also it may be determined that the signal after the wideband switching is a harmonic signal when either condition of the two conditions that the harmonic frequency band quantity is greater than T51 and the maximum peak value parameter is greater than T41 is met, thereby further loosening the harmonic signal determining condition.

In a case that the harmonic frequency band quantity is less than or equal to T51 and the maximum peak value parameter is less than or equal to T41, that is, neither of the foregoing two conditions is met, in this embodiment, the determining may also be performed according to a value of the harmonic mode counter. If the harmonic mode count value is greater than a preset value T8, it may be determined that the wideband signal after the wideband switching is a harmonic signal.

Step 206. Increase at least one threshold of the harmonic frequency band quantity threshold and the maximum peak value parameter threshold in the harmonic signal determining condition for the wideband signal.

Because the ultra-wideband signal before the wideband switching is a non-harmonic signal, for example, a transient signal, a condition of determining that the wideband signal after the wideband switching is a harmonic signal needs to be increased in step 206. In this embodiment, at least one threshold of the harmonic frequency band quantity threshold T5 and the maximum peak value parameter threshold T4 in the harmonic signal determining condition for the wideband signal may be increased. It may be understood that, for an adjusting manner of increasing both T4 and T5, an increasing degree of the harmonic signal determining condition is relatively larger when compared with an adjusting manner of increasing T4 only or increasing T5 only. In this embodiment, an increased harmonic frequency band quantity threshold may be marked as T52, where T52<T5; and an increased maximum peak value parameter threshold is marked as T42, where T42<T4. For example, T51 may be the double of T5, and T41 is the double of T4.

A person skilled in the art may understand that specific values of T52 and T42 may also be set according to a harmonic signal determining requirement. For example, if it needs to be determined that a wideband signal with relatively many harmonic features is a harmonic signal, T52 and T42 may be adjusted to larger values so that it can be determined that the wideband signal with distinct harmonic features is a harmonic signal.

Step 207. If the quantity of harmonic frequency bands is greater than an increased harmonic frequency band quantity threshold and/or the maximum peak value parameter is greater than an increased maximum peak value parameter threshold, determine that the wideband signal is a harmonic signal.

After the harmonic signal determining condition is increased, if either condition of the two conditions that the harmonic frequency band quantity is greater than T52 and the maximum peak value parameter is greater than T42 is met, it can be determined that the wideband signal after the wideband switching is a harmonic signal.

In a case that the quantity of harmonic frequency bands is less than or equal to T52 and the maximum peak value parameter is less than or equal to T42, that is, neither of the foregoing two conditions is met, in this embodiment, the determining may also be performed according to a value of the harmonic mode counter. If the harmonic mode count value is greater than a preset value T8, it may also be determined that the wideband signal after the wideband switching is a harmonic signal.

In this embodiment, when wideband switching occurs at an encoder, a coding apparatus can determine whether an ultra-wideband signal before the wideband switching is a harmonic signal or a non-harmonic signal; if the ultra-wideband signal is a harmonic signal, the coding apparatus can lower a determining threshold of a harmonic frequency band quantity and/or a maximum peak value parameter that are used to represent harmonic components of a signal, so as to determine as much as possible that a wideband signal after the wideband switching is a harmonic signal; if the ultra-wideband signal is a non-harmonic signal, the coding apparatus can raise the determining threshold used for the harmonic frequency band quantity and/or a maximum peak value parameter, so as to determine as much as possible that the wideband signal after the wideband switching is a non-harmonic signal. In addition, after the harmonic signal determining condition is adjusted, even though the wideband signal after the wideband switching does not meet the foregoing condition, the determining may further be performed with assistance of a harmonic mode counter. Therefore, in this embodiment, during the wideband switching, a signal type is not changed as much as possible, and therefore continuity of a speech/audio signal received at a decoder can be ensured as much as possible.

Figure 3:
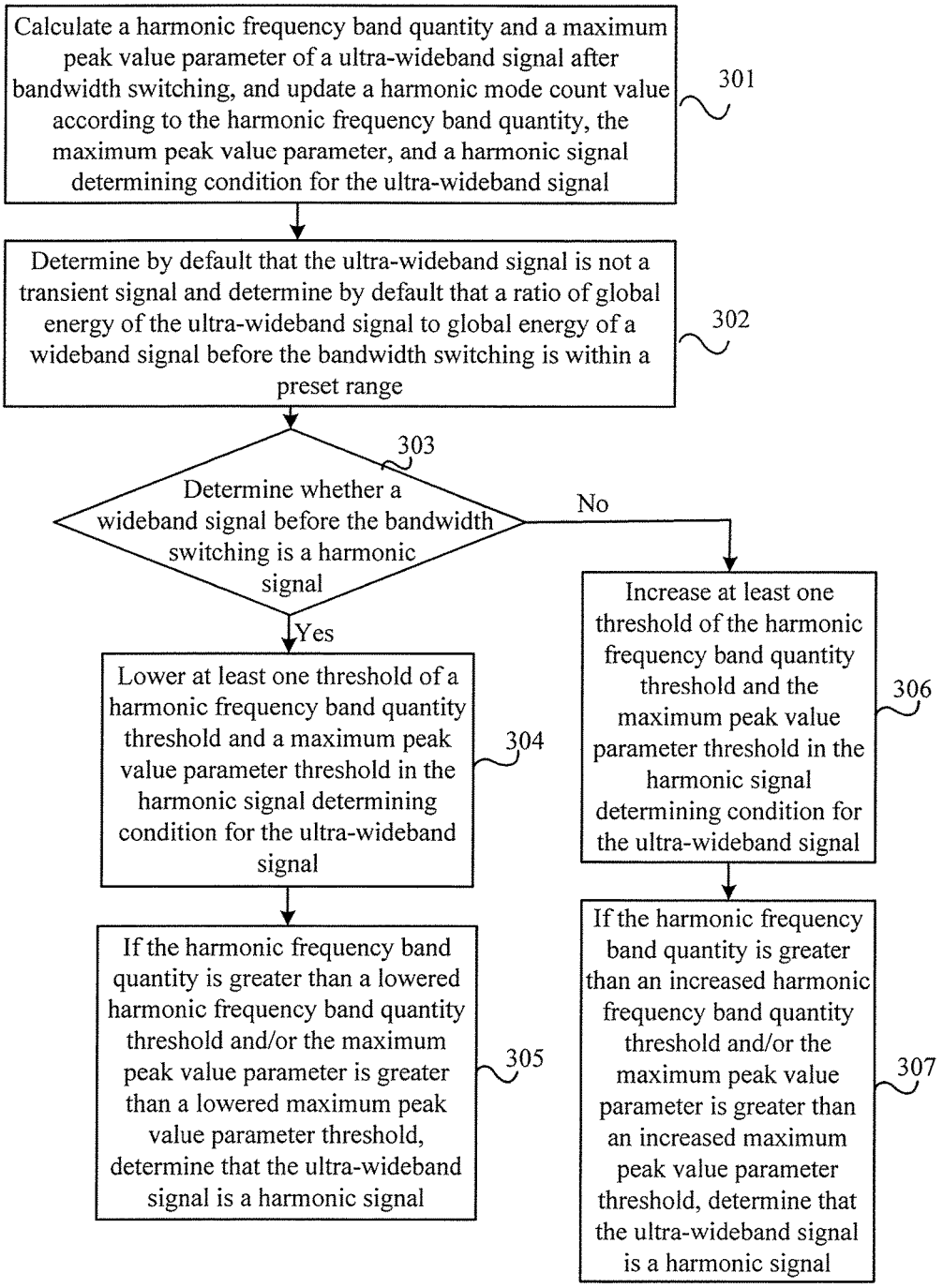
FIG. 3 is a flowchart of a third embodiment of a speech/audio signal processing method according to the present disclosure.

FIG. 3 is a flowchart of a third embodiment of a speech/audio signal processing method according to the present disclosure. In this embodiment, a first wideband speech/audio signal is a wideband signal, a second wideband speech/audio signal is an ultra-wideband signal, and wideband switching is switching from the wideband signal to the ultra-wideband signal. As shown in FIG. 3, the method in this embodiment may include:

Step 301: Calculate a quantity of harmonic frequency bands and a maximum peak value parameter of an ultra-wideband signal after the wideband switching, and update a harmonic mode count value according to the quantity of harmonic frequency bands, the maximum peak value parameter, and a harmonic signal determining condition for the ultra-wideband signal.

For step 301, refer to the foregoing implementation related to a process of determining a signal type of an ultra-wideband signal and therefore no further details are provided herein.

Step 302. Determine by default that the ultra-wideband signal is not a transient signal and determine by default that a ratio of global energy of the ultra-wideband signal to global energy of a wideband signal before the wideband switching falls within a preset range.

In this embodiment, the wideband switching is switching from the wideband signal to the ultra-wideband signal, the ultra-wideband signal includes four signal types, and compared with the harmonic signal determining condition for the wideband signal, the ratio of the global energy of the ultra-wideband signal after the wideband switching to the global energy of the wideband signal before the wideband switching is added as the harmonic signal determining condition for the ultra-wideband signal. Therefore, in this embodiment, to simplify the determining condition, step 1 to step 3 may not be performed and it is determined by default that the ultra-wideband signal after the wideband switching is not a transient signal in step 302, and it may also be determined by default that the ratio of the global energy of the ultra-wideband signal after the wideband switching to the global energy of the wideband signal before the wideband switching falls within a preset range (T6, T7).

Step 303. Determine whether a wideband signal before the wideband switching is a harmonic signal. If the wideband signal before the wideband switching is a harmonic signal, perform step 304; if the wideband signal before the wideband switching is not a harmonic signal, perform step 306.

Step 304. Lower at least one threshold of a harmonic frequency band quantity threshold and a maximum peak value parameter threshold in the harmonic signal determining condition for the ultra-wideband signal.

Because the wideband signal before the wideband switching is a harmonic signal, a condition of determining that the ultra-wideband signal after the wideband switching is a harmonic signal needs to be loosened in step 304. In this embodiment, at least one threshold of the harmonic frequency band quantity threshold T5 and the maximum peak value parameter threshold T4 in the harmonic signal determining condition for the ultra-wideband signal may be decreased. The decreased harmonic frequency band quantity threshold is also marked as T51, and the decreased maximum peak value parameter threshold is also marked as T41.

Step 305. If the quantity of harmonic frequency bands is greater than a decreased harmonic frequency band quantity threshold and/or the maximum peak value parameter is greater than a decreased maximum peak value parameter threshold, determine that the ultra-wideband signal is a harmonic signal.

After the harmonic signal determining condition is loosened, if either condition of the two conditions that the quantity of harmonic frequency bands is greater than the decreased harmonic frequency band quantity threshold and the maximum peak value parameter is greater than the decreased maximum peak value parameter threshold is met, it can be determined that the ultra-wideband signal after the wideband switching is a harmonic signal.

In a case that the quantity of harmonic frequency bands is less than or equal to T51 and the maximum peak value parameter is less than or equal to T41, that is, neither of the foregoing two conditions is met, in this embodiment, the determining may also be performed according to a value of the harmonic mode counter. If the harmonic mode count value is greater than a preset value T8, the ultra-wideband signal after the wideband switching is a harmonic signal.

Step 306. Increase at least one threshold of the harmonic frequency band quantity threshold and the maximum peak value parameter threshold in the harmonic signal determining condition for the ultra-wideband signal.

Step 307. If the quantity of harmonic frequency bands is greater than an increased harmonic frequency band quantity threshold and/or the maximum peak value parameter is greater than an increased maximum peak value parameter threshold, determine that the ultra-wideband signal is a harmonic signal.

After the harmonic signal determining condition is increased, if either condition of the two conditions that the quantity of harmonic frequency bands is greater than the increased harmonic frequency band quantity threshold T52 and the maximum peak value parameter is greater than the increased maximum peak value parameter threshold T42 is met, it can be determined that the ultra-wideband signal after the wideband switching is a harmonic signal.

In a case that the quantity of harmonic frequency bands is less than or equal to T52 and the maximum peak value parameter is less than or equal to T42, that is, neither of the foregoing two conditions is met, in this embodiment, the determining may also be performed according to a value of the harmonic mode counter. If the harmonic mode count value is greater than a preset value T8, it may also be determined that the ultra-wideband signal after the wideband switching is a harmonic signal.

Alternatively, in this embodiment, steps 1 to 3 may also be performed to determine whether the ultra-wideband signal after the wideband switching is a transient signal. In addition, to ensure signal continuity, a transient signal determining condition can be increased in this embodiment, so that it can be determined that an ultra-wideband signal which actually has a relatively significant transient feature is a transient signal.

In actual implementation, a coding apparatus may use the foregoing step 1 to calculate a time envelope parameter of the ultra-wideband signal and increase a time domain envelope threshold T1 in step 2, where an increased envelope threshold can be marked as T11; and, if the time envelope parameter is greater than T11, it may be determined that the ultra-wideband signal is a transient signal. For example, if the wideband signal before the wideband switching is a harmonic signal, the envelope threshold may be increased by three times; if the wideband signal before the wideband switching is a non-harmonic signal, the envelope threshold may be increased by two times.

In this embodiment, when wideband switching occurs at an encoder, a coding apparatus can determine whether a wideband signal before the wideband switching is a harmonic signal or a non-harmonic signal; if the wideband signal is a harmonic signal, the coding apparatus can lower a determining threshold of a harmonic frequency band quantity and/or a maximum peak value parameter that are used to represent harmonic components of a signal, so as to determine as much as possible that an ultra-wideband signal after the wideband switching is a harmonic signal; if the wideband signal is a non-harmonic signal, the coding apparatus can raise a determining threshold used for the harmonic frequency band quantity and/or the maximum peak value parameter, so as to determine as much as possible that the ultra-wideband signal after the wideband switching is a non-harmonic signal. In addition, after the harmonic signal determining condition is adjusted, even though the ultra-wideband signal after the wideband switching does not meet the foregoing condition, the determining may further be performed with assistance of a harmonic mode counter. Therefore, in this embodiment, during the wideband switching, a signal type is not changed as much as possible, and therefore continuity of a speech/audio signal received at a decoder can be ensured as much as possible.

Figure 4:
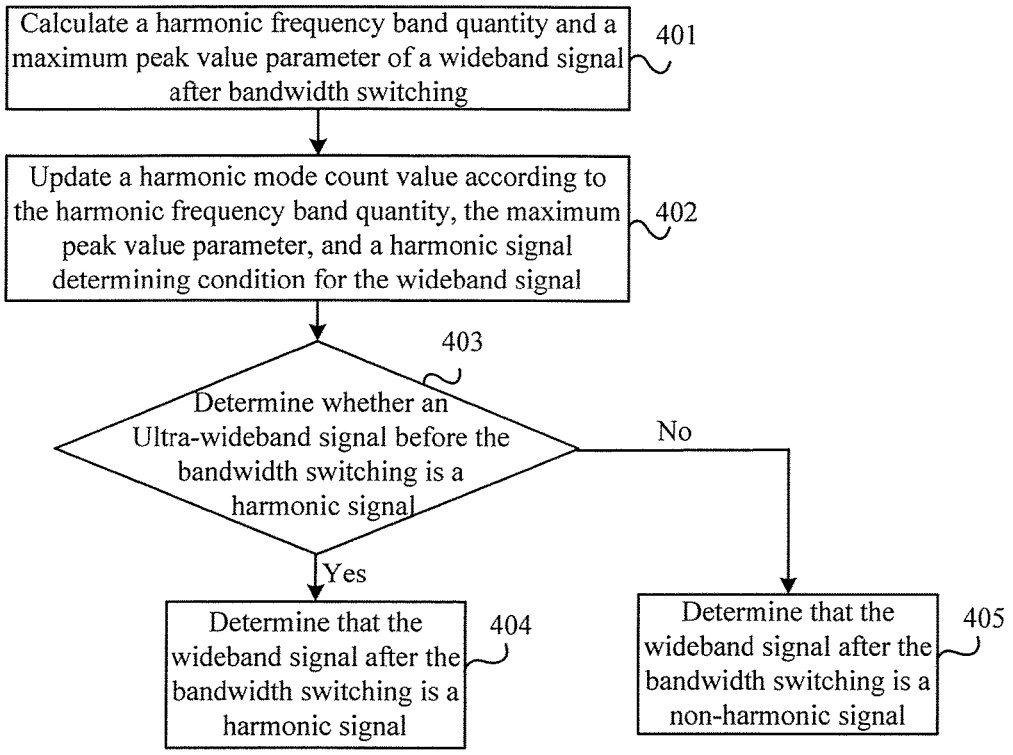
FIG. 4 is a flowchart of a fourth embodiment of a speech/audio signal processing method according to the present disclosure.

FIG. 4 is a flowchart of a fourth embodiment of a speech/audio signal processing method based on wideband switching according to the present disclosure. In this embodiment, a first wideband speech/audio signal is an ultra-wideband signal, a second wideband speech/audio signal is a wideband signal, and wideband switching is switching from the ultra-wideband signal to the wideband signal. As shown in FIG. 4, the method in this embodiment may include:

Step 401. Calculate a quantity of harmonic frequency bands and a maximum peak value parameter of a wideband signal after the wideband switching.

Step 402. Update a harmonic mode count value according to the quantity of harmonic frequency bands, the maximum peak value parameter, and a harmonic signal determining condition for the wideband signal.

Step 403. Determine whether an ultra-wideband signal before the wideband switching is a harmonic signal. If the ultra-wideband signal before the wideband switching is a harmonic signal, perform step 404; if the ultra-wideband signal before the wideband switching is not a harmonic signal, perform step 405.

For step 401 to step 403, refer to a process of performing step 201 to step 203 in the embodiment shown in FIG. 2, and therefore no further details are provided herein.

Step 404. Determine that the wideband signal after the wideband switching is a harmonic signal.

Step 405. Determine that the wideband signal after the wideband switching is a non-harmonic signal.

A difference between this embodiment and the method embodiment shown in FIG. 2 lies in that: in the method embodiment shown in FIG. 2, the determining whether the wideband signal after the wideband switching is a harmonic signal is performed by adjusting a determining threshold in the harmonic signal determining condition; in this embodiment, the harmonic signal determining condition is adjusted to that: as long as an ultra-wideband signal before the wideband switching is a harmonic signal, it is also forcibly determined that the wideband signal after the wideband switching is a harmonic signal; as long as the ultra-wideband signal before the wideband switching is a non-harmonic signal, it is also forcibly determined that the wideband signal after the wideband switching is a non-harmonic signal.

In this embodiment, when wideband switching occurs at an encoder, a coding apparatus can determine whether an ultra-wideband signal before the wideband switching is a harmonic signal or a non-harmonic signal, and if the ultra-wideband signal is a harmonic signal, the coding apparatus forcibly determines that a wideband signal after the wideband switching is a harmonic signal; if the ultra-wideband signal is a non-harmonic signal, the coding apparatus forcibly determines that a wideband signal after the wideband switching is a non-harmonic signal. Therefore, in this embodiment, during the wideband switching, a signal type is not changed, and therefore continuity of a speech/audio signal can be ensured as much as possible for a speech/audio signal received at a decoder.

Figure 5:
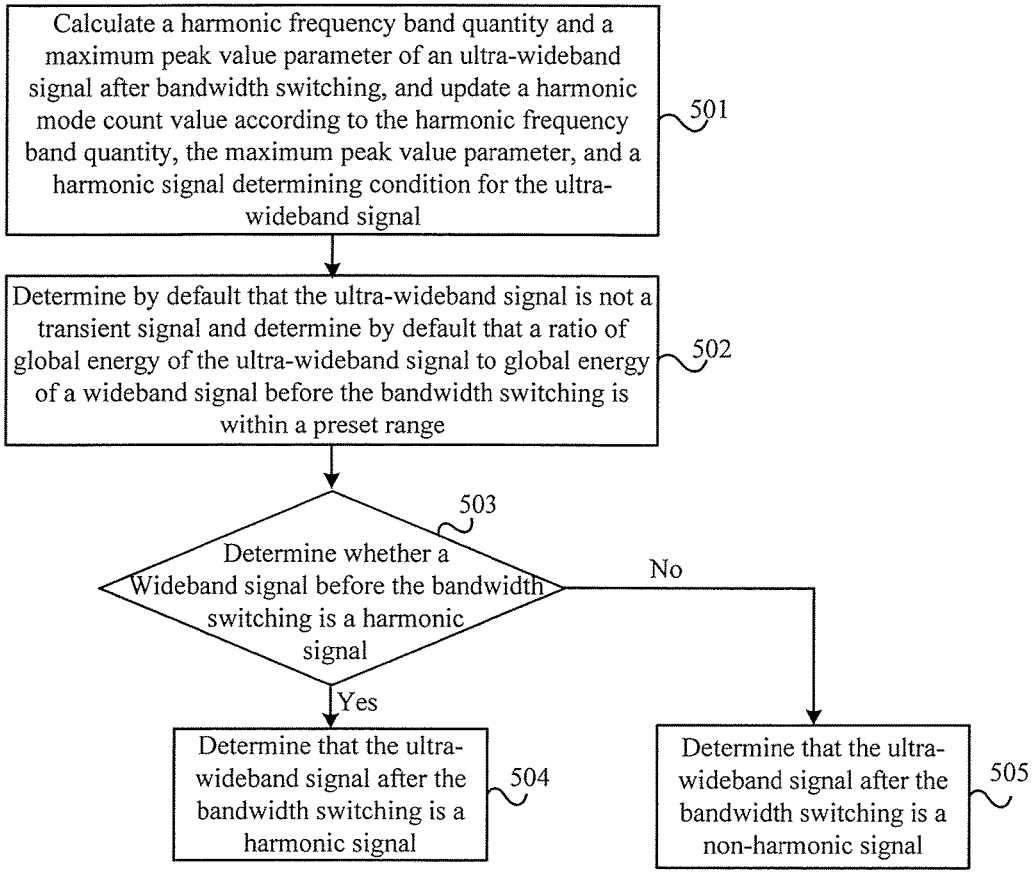
FIG. 5 is a flowchart of a fifth embodiment of a speech/audio signal processing method according to the present disclosure.

FIG. 5 is a flowchart of a fifth embodiment of a speech/audio signal processing method based on wideband switching according to the present disclosure. In this embodiment, a first wideband speech/audio signal is a wideband signal, a second wideband speech/audio signal is an ultra-wideband signal, and wideband switching is switching from the wideband signal to the ultra-wideband signal. As shown in FIG. 5, the method in this embodiment may include:

Step 501: Calculate a quantity of harmonic frequency bands and a maximum peak value parameter of an ultra-wideband signal after the wideband switching, and update a harmonic mode count value according to the quantity of harmonic frequency bands, the maximum peak value parameter, and a harmonic signal determining condition for the ultra-wideband signal.

Step 502. Determine by default that the ultra-wideband signal is not a transient signal and determine by default that a ratio of global energy of the ultra-wideband signal to global energy of a wideband signal before the wideband switching falls within a preset range.

Step 503. Determine whether a wideband signal before the wideband switching is a harmonic signal. If the wideband signal before the wideband switching is a harmonic signal, perform step 504; if the wideband signal before the wideband switching is not a harmonic signal, perform step 505.

For step 501 to step 503, refer to a process of performing step 301 to step 303 in the embodiment shown in FIG. 3, and therefore no further details are provided herein.

Step 504. Determine that the ultra-wideband signal after the wideband switching is a harmonic signal.

Step 505. Determine that the ultra-wideband signal after the wideband switching is a non-harmonic signal.

A difference between this embodiment and the method embodiment shown in FIG. 3 lies in that: in the method embodiment shown in FIG. 3, the determining whether the ultra-wideband signal after the wideband switching is a harmonic signal is performed by adjusting a determining threshold in the harmonic signal determining condition; in this embodiment, the harmonic signal determining condition is adjusted to that: as long as the wideband signal before the wideband switching is a harmonic signal, it is also forcibly determined that the ultra-wideband signal after the wideband switching is a harmonic signal; as long as the wideband signal before the wideband switching is a non-harmonic signal, it is also forcibly determined that the ultra-wideband signal after the wideband switching is a non-harmonic signal.

In this embodiment, when wideband switching occurs at an encoder, a coding apparatus can determine whether a wideband signal before the wideband switching is a harmonic signal or a non-harmonic signal, and if the wideband signal is a harmonic signal, the coding apparatus forcibly determines that an ultra-wideband signal after the wideband switching is a harmonic signal; if the wideband signal is a non-harmonic signal, the coding apparatus forcibly determines that an ultra-wideband signal after the wideband switching is a non-harmonic signal. Therefore, in this embodiment, during the wideband switching, a signal type is not changed, and therefore continuity of a speech/audio signal can be ensured as much as possible for a speech/audio signal received at a decoder.

Figure 6:
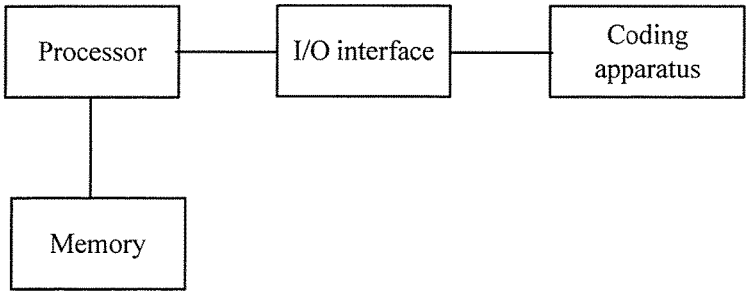
FIG. 6 is a schematic structural diagram of an encoder device in which a coding apparatus according to the present disclosure is disposed.

Associated with the method embodiments, the present disclosure further provides a coding apparatus, where the apparatus may be located in a terminal device, a network device, or a test device. The coding apparatus may be implemented by hardware circuits or be implemented by software working with hardware. For example, referring to FIG. 6, a processor invokes a coding apparatus to implement processing of a speech/audio signal. The coding apparatus may perform various methods and processes in the method embodiments. The coding apparatus may include a determining condition adjusting module and a signal type determining module.

Figure 7:
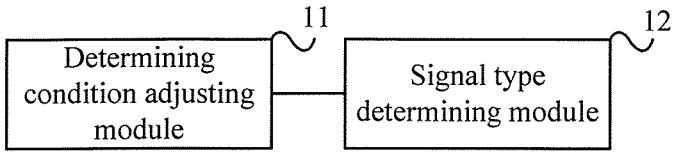
FIG. 7 is a schematic structural diagram of a first embodiment of a coding apparatus according to the present disclosure.

FIG. 7 is a schematic structural diagram of a first embodiment of a coding apparatus according to the present disclosure. As shown in FIG. 7, the coding apparatus in this embodiment includes: a determining condition adjusting module 11 and a signal type determining module 12. The determining condition adjusting module 11 is configured to: if a first wideband speech/audio signal is a harmonic signal, adjust a determining condition for determining that a second wideband speech/audio signal is a harmonic signal, to obtain a first determining condition, so as to raise a possibility of determining that the second wideband speech/audio signal is a harmonic signal, where the first wideband speech/audio signal is a speech/audio signal before the wideband switching, and the second wideband speech/audio signal is a speech/audio signal after the wideband switching. The signal type determining module 12 is configured to determine, according to the first determining condition, whether the second wideband speech/audio signal is a harmonic signal.

Specifically, the determining condition adjusting module 11 is configured to loosen the determining condition for determining that the second wideband speech/audio signal is a harmonic signal, where a loosened determining condition is used as the first determining condition.

Figure 8:
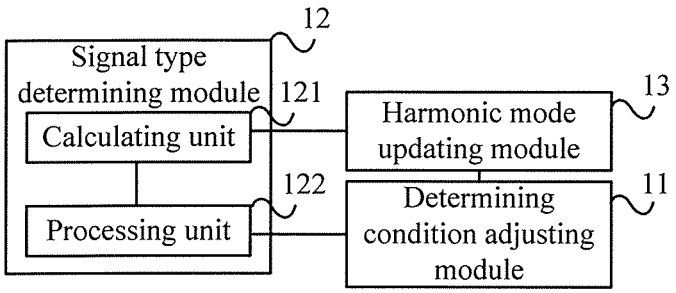
FIG. 8 is a schematic structural diagram of a second embodiment of a coding apparatus according to the present disclosure.

FIG. 8 is a schematic structural diagram of a second embodiment of a coding apparatus according to the present disclosure. As shown in FIG. 8, in addition to modules of the apparatus shown in FIG. 7, the apparatus in this embodiment further includes: a harmonic mode updating module 13.

In this embodiment, the determining condition adjusting module 11 is specifically configured to lower at least one threshold of a harmonic frequency band quantity threshold and a maximum peak value parameter threshold in the determining condition for determining that the second wideband speech/audio signal is a harmonic signal; and correspondingly, the signal type determining module 12 may include: a calculating unit 121 and a processing unit 122, where the calculating unit 121 is configured to calculate a harmonic frequency band quantity and a maximum peak value parameter of the second wideband speech/audio signal, and the processing unit 122 is configured to, if the harmonic frequency band quantity is greater than a decreased harmonic frequency band quantity threshold and/or the maximum peak value parameter is greater than a decreased maximum peak value parameter threshold, determine that the second wideband speech/audio signal is a harmonic signal.

The harmonic mode updating module 13 is configured to update a harmonic mode count value according to a relationship among the harmonic frequency band quantity, the maximum peak value parameter, and the determining condition for determining that the second wideband speech/audio signal is a harmonic signal; and correspondingly, the signal type determining module 12 is further configured to, if the harmonic frequency band quantity is less than or equal to the decreased harmonic frequency band quantity threshold and the maximum peak value parameter is less than or equal to the decreased maximum peak value parameter threshold, determine that the second wideband speech/audio signal is a harmonic signal.

Further, the harmonic mode updating module 13 is specifically configured to: if the harmonic frequency band quantity is greater than the harmonic frequency band quantity threshold and the maximum peak value parameter is greater than the maximum peak value parameter threshold, increase the harmonic mode count value; and, if the harmonic frequency band quantity is less than or equal to the harmonic frequency band quantity threshold and/or the maximum peak value parameter is less than or equal to the maximum peak value parameter threshold, decrease the harmonic mode count value.

In a case that the wideband switching is switching from a wideband signal to an ultra-wideband signal, that is, the first wideband speech/audio signal is a wideband signal and the second wideband speech/audio signal is an ultra-wideband signal, the determining condition adjusting module 11 is further configured to calculate a time envelope parameter of the ultra-wideband signal and increase an envelope threshold in a transient signal determining condition; if the time envelope parameter is greater than or equal to an increased envelope threshold, determine that the ultra-wideband signal is a transient signal; and, if the time envelope parameter is less than the increased envelope threshold, determine by default that the ultra-wideband signal is not a transient signal and determine by default that a ratio of global energy of the ultra-wideband signal to global energy of the wideband signal falls within a preset range. In actual implementation, the determining condition adjusting module 11 is specifically configured to: if the wideband signal is a harmonic signal, increase the envelope threshold by three times; and, if the wideband signal is a non-harmonic signal, increase the envelope threshold by two times.

In another embodiment of the coding apparatus according to the present disclosure, based on the coding apparatus embodiment shown in FIG. 7, the signal type determining module 12 may be specifically configured to determine, according to the first determining condition, that the second wideband speech/audio signal is a harmonic signal; or, the signal type determining module 12 is further configured to: if the first wideband speech/audio signal is not a harmonic signal, determine that the second wideband speech/audio signal is a non-harmonic signal.

In still another embodiment of the coding apparatus according to the present disclosure, based on the coding apparatus embodiment shown in FIG. 7, the determining condition adjusting module 11 is further configured to: if the first wideband speech/audio signal is not a harmonic signal, adjust the harmonic signal determining condition to obtain a second determining condition, so as to lower the possibility of determining that the second wideband speech/audio signal is a harmonic signal; and correspondingly, the signal type determining module 12 is further configured to determine, according to the second determining condition, whether the second wideband speech/audio signal is a harmonic signal. Specifically, the determining condition adjusting module 11 is configured to increase at least one threshold of the harmonic frequency band quantity threshold and the maximum peak value parameter threshold in the determining condition for determining that the second wideband speech/audio signal is a harmonic signal; and correspondingly, the signal type determining module 12 is specifically configured to: if the harmonic frequency band quantity is greater than an increased harmonic frequency band quantity threshold and/or the maximum peak value parameter is greater than an increased maximum peak value parameter threshold, determine that the second wideband speech/audio signal is a harmonic signal.

The coding apparatus in the foregoing embodiments of the present disclosure may correspondingly perform the technical solutions in the method embodiments shown in FIG. 1 to FIG. 5, and implementation principles and technical effects in the embodiments of the coding apparatus are similar to those in the method embodiments. Therefore, no further details are provided herein.

A person of ordinary skill in the art may understand that all or a part of the steps of the method embodiments may be implemented by a program instructing relevant hardware. The program may be stored in a computer readable storage medium. When the program runs, the steps of the method embodiments are performed. The foregoing storage medium includes: any medium that can store program code, such as a ROM, a RAM, a magnetic disk, or an optical disc.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present disclosure.

What is claimed is:

1. A speech/audio signal processing method performed by an encoder configured on a processor, the method comprising:

the encoder configured on the processor determining if a first wideband speech/audio signal is a harmonic signal;

when the first wideband speech/audio signal is a harmonic signal, the encoder configured on the processor adjusting a determining condition to generate a broader determining condition, with the broader determining condition being generated to increase a probability of determining that a second wideband speech/audio signal is a harmonic signal, wherein a first wideband speech/audio signal bandwidth is different from a second wideband speech/audio signal bandwidth;

the encoder configured on the processor determining whether the second wideband speech/audio signal is a harmonic signal, using the broader determining condition; and selecting a coding method for a harmonic signal to code a harmonic signal before the bandwidth switching and use a coding method for a non-harmonic signal to code a non-harmonic signal after the bandwidth switching;

encoding the signal using the selection.

2. The method according to claim 1, wherein:

adjusting the determining condition to generate the broader determining condition comprises:

the encoder decreasing at least one of a harmonic frequency band quantity threshold and a maximum peak value parameter threshold included in the determining condition; and determining, according to the broader determining condition, whether the second wideband speech/audio signal is a harmonic signal comprises:

the encoder calculating a harmonic frequency band quantity and a maximum peak value parameter of the second wideband speech/audio signal, and the encoder determining that the second wideband speech/audio signal is a harmonic signal if the harmonic frequency band quantity is greater than a decreased harmonic frequency band quantity threshold and/or the maximum peak value parameter is greater than a decreased maximum peak value parameter threshold.

3. The method according to claim 2, further comprising:

the encoder updating a harmonic mode count value according to a relationship among the harmonic frequency band quantity, the maximum peak value parameter, and the determining condition; and if the harmonic frequency band quantity is less than or equal to the decreased harmonic frequency band quantity threshold and the maximum peak value parameter is less than or equal to the decreased maximum peak value parameter threshold, the method further comprises:

the encoder determining that the second wideband speech/audio signal is a harmonic signal if the harmonic mode count value is greater than a preset value.

4. The method according to claim 3, wherein updating the harmonic mode count value comprises:

the encoder increasing the harmonic mode count value if the harmonic frequency band quantity is greater than the harmonic frequency band quantity threshold and the maximum peak value parameter is greater than the maximum peak value parameter threshold; and the encoder decreasing the harmonic mode count value if the harmonic frequency band quantity is less than or equal to the harmonic frequency band quantity threshold and/or the maximum peak value parameter is less than or equal to the maximum peak value parameter threshold.

5. The method according to claim 3, wherein the first wideband speech/audio signal is a wideband signal, the second wideband speech/audio signal is an ultra-wideband signal, and before determining, according to the broader determining condition, whether the second wideband speech/audio signal is a harmonic signal, the method further comprises:

the encoder calculating a time envelope parameter of the ultra-wideband signal and increasing an envelope threshold in a transient signal determining condition;

the encoder determining that the ultra-wideband signal is a transient signal if the time envelope parameter is greater than or equal to an increased envelope threshold; and the encoder determining by default that the ultra-wideband signal is not a transient signal and determining by default that a ratio of global energy of the ultra-wideband signal to global energy of the wideband signal falls within a preset range if the time envelope parameter is less than the increased envelope threshold.

6. The method according to claim 5, wherein increasing the envelope threshold in the transient signal determining condition comprises:

the encoder increasing the envelope threshold by three times if the wideband signal is a harmonic signal; and the encoder increasing the envelope threshold by two times if the wideband signal is a non-harmonic signal.

7. The method according to claim 1, wherein determining, according to the broader determining condition, whether the second wideband speech/audio signal is a harmonic signal comprises:

the encoder determining, according to the broader determining condition, that the second wideband speech/audio signal is a harmonic signal.

8. The method according to claim 1, further comprising:

if the first wideband speech/audio signal is not a harmonic signal, the encoder adjusting the determining condition to generate a narrower determining condition, with the narrower determining condition being generated to decrease a probability of determining that the second wideband speech/audio signal is a harmonic signal; and the encoder determining whether the second wideband speech/audio signal is a harmonic signal, using the narrower determining condition.

9. The method according to claim 8, wherein:

adjusting the determining condition to generate the narrower determining condition comprises:

the encoder increasing at least one of a harmonic frequency band quantity threshold and a maximum peak value parameter threshold in the determining condition; and wherein determining whether the second wideband speech/audio signal is a harmonic signal comprises:

the encoder determining that the second wideband speech/audio signal is a harmonic signal if the harmonic frequency band quantity is greater than an increased harmonic frequency band quantity threshold and/or the maximum peak value parameter is greater than an increased maximum peak value parameter threshold.

10. The method according to claim 1, further comprising:

the encoder determining that the second wideband speech/audio signal is a non-harmonic signal if the first wideband speech/audio signal is not a harmonic signal.

11. A coding apparatus, comprising:

a non-transitory memory storage comprising instructions; and a processor in communication with the memory, wherein the processor executes the instructions to:

determine if a first wideband speech/audio signal is a harmonic signal;

when the first wideband speech/audio signal is a harmonic signal, adjust a determining condition to generate a broader determining condition, with the broader determining condition being generated to increase a probability of determining that a second wideband speech/audio signal is a harmonic signal, wherein a first wideband speech/audio signal bandwidth is different from a second wideband speech/audio signal bandwidth; and determine whether the second wideband speech/audio signal is a harmonic signal using the broader determining condition selecting a coding method for a harmonic signal to code a harmonic signal before the bandwidth switching and use a coding method for a non-harmonic signal to code a non-harmonic signal after the bandwidth switching; and encoding the signal using the selection.

12. The apparatus according to claim 11, wherein the processor further executes the instructions to:

decrease at least one of a harmonic frequency band quantity threshold and a maximum peak value parameter threshold included in the determining condition;

calculate a harmonic frequency band quantity and a maximum peak value parameter of the second wideband speech/audio signal; and determine that the second wideband speech/audio signal is a harmonic signal if the harmonic frequency band quantity is greater than a decreased harmonic frequency band quantity threshold and/or the maximum peak value parameter is greater than a decreased maximum peak value parameter threshold.

13. The apparatus according to claim 12, wherein the processor further executes the instructions to:

update a harmonic mode count value according to a relationship among the harmonic frequency band quantity, the maximum peak value parameter, and the determining condition; and determine that the second wideband speech/audio signal is a harmonic signal if the harmonic frequency band quantity is less than or equal to the decreased harmonic frequency band quantity threshold, the maximum peak value parameter is less than or equal to the decreased maximum peak value parameter threshold, and the harmonic mode count value is greater than a preset value.

14. The apparatus according to claim 13, wherein the processor further executes the instructions to:

increase the harmonic mode count value if the harmonic frequency band quantity is greater than the harmonic frequency band quantity threshold and the maximum peak value parameter is greater than the maximum peak value parameter threshold; and decrease the harmonic mode count value if the harmonic frequency band quantity is less than or equal to the harmonic frequency band quantity threshold and/or the maximum peak value parameter is less than or equal to the maximum peak value parameter threshold.

15. The apparatus according to claim 12, wherein:

the first wideband speech/audio signal is a wideband signal;

the second wideband speech/audio signal is an ultra-wideband signal;

wherein the processor further executes the instructions to:

calculate a time envelope parameter of the ultra-wideband signal and increase an envelope threshold in a transient signal determining condition;

determine that the ultra-wideband signal is a transient signal if the time envelope parameter is greater than or equal to an increased envelope threshold; and determine by default that the ultra-wideband signal is not a transient signal and determining by default that a ratio of global energy of the ultra-wideband signal to global energy of the wideband signal falls within a preset range if the time envelope parameter is less than the increased envelope threshold.

16. The apparatus according to claim 15, wherein the processor further executes the instructions to:

increase the envelope threshold by three times if the wideband signal is a harmonic signal; and increase the envelope threshold by two times if the wideband signal is a non-harmonic signal.

17. The apparatus according to claim 11, wherein the processor further executes the instructions to determine, according to the broader determining condition, that the second wideband speech/audio signal is a harmonic signal.

18. The apparatus according to claim 11, wherein the processor further executes the instructions to:

if the first wideband speech/audio signal is not a harmonic signal, adjust the determining condition to generate a narrower determining condition, with the narrower determining condition being generated to decrease a probability of determining that the second wideband speech/audio signal is a harmonic signal; and determine whether the second wideband speech/audio signal is a harmonic signal, using the narrower determining condition.

19. The apparatus according to claim 18, wherein the processor further executes the instructions to:

increase at least one of a harmonic frequency band quantity threshold and a maximum peak value parameter threshold in the determining condition; and determine that the second wideband speech/audio signal is a harmonic signal if the harmonic frequency band quantity is greater than an increased harmonic frequency band quantity threshold and/or the maximum peak value parameter is greater than an increased maximum peak value parameter threshold.

20. The apparatus according to claim 11, wherein the processor further executes the instructions to determine that the second wideband speech/audio signal is a non-harmonic signal if the first wideband speech/audio signal is not a harmonic signal.

* * * * *